US005845464A

United States Patent [19]

Draghetti

[11] Patent Number: 5,845,464

[45] Date of Patent: Dec. 8, 1998

[54] PRODUCT WRAPPING METHOD

[75] Inventor: Fiorenzo Draghetti, Medicina, Italy

[73] Assignee: G.D Società per Azioni, Bologna, Italy

[21] Appl. No.: 816,634

[22] Filed: Mar. 13, 1997

[30] Foreign Application Priority Data

Mar. 15, 1996 [IT] Italy ..... BO96A 0142

[51] Int. Cl.[6] ..... B65B 11/20; B65B 19/00

[52] U.S. Cl. ..... 53/466; 53/64; 53/230

[58] Field of Search ..... 53/466, 504, 503, 53/66, 64, 230, 228, 233, 232

[56] References Cited

U.S. PATENT DOCUMENTS

| | | | |
|---|---|---|---|
| 3,507,089 | 4/1970 | Mizelle | 53/466 |
| 3,982,375 | 9/1976 | Focke | 53/466 |
| 4,135,344 | 1/1979 | Seragnoli | 53/54 |
| 4,617,780 | 10/1986 | Focke et al. | 53/466 |

FOREIGN PATENT DOCUMENTS

| | | |
|---|---|---|
| 0443787 | 8/1991 | European Pat. Off. . |
| 0532944 | 3/1993 | European Pat. Off. . |
| 3515655 | 11/1985 | Germany . |
| 2014938 | 9/1979 | United Kingdom . |
| 2213456 | 8/1989 | United Kingdom . |

*Primary Examiner*—James F. Coan
*Attorney, Agent, or Firm*—Ladas & Parry

[57] ABSTRACT

A method of wrapping products, whereby a sheet and a respective product for wrapping are fed to a wrapping station in a first and second direction incident with each other; the product travels according to a given movement through the wrapping station to engage the sheet, upon the sheet reaching a given intercept position, and to feed the sheet in the second direction to form a U-shaped wrapping; and the sheet is fed in the first direction through the wrapping station and at most into the intercept position according to any movement as a function of the length of the sheet, and subsequently travels according to the same movement as the product.

15 Claims, 2 Drawing Sheets

PRODUCT WRAPPING METHOD

BACKGROUND OF THE INVENTION

The present invention relates to a product wrapping method.

The present invention is especially advantageous for use on continuous overwrapping machines, particularly cellophaning machines for products such as packets or cartons of cigarettes, to which the following description refers purely by way of example.

On overwrapping machines of the aforementioned type, a number of products are fed successively and at constant speed along a supply path to a wrapping station where a respective sheet of synthetic transparent material (normally polypropylene). is folded into a. U about each product to be overwrapped.

The product and sheet are normally mated with, no difficulty in the case of step-operated overwrapping machines, on which each sheet is usually arrested at the wrapping station until it is mated with the product. Problems arise, on the other hand, when both the sheet and product are fed continuously through the wrapping station, in which case, it is relatively difficult to keep the sheet in the correct position with respect to the product throughout formation of the wrapping.

The same problems are also encountered on step-operated overwrapping machines, if, to increase the output speed of the machine, the sheet is preferably not arrested at the wrapping station.

SUMMARY OF THE INVENTION

It is an object of the present invention to provide a wrapping method designed to satisfactorily solve the aforementioned problems.

According to the present invention, there is provided a method of wrapping products, the method comprising the steps of feeding a sheet and a respective product for wrapping to a wrapping station in a first and respectively second direction incident with each other; the product traveling according to a first given movement through the wrapping station to engage the sheet, upon the sheet reaching a given intercept position, and to feed the sheet in the second direction to form a U-shaped wrapping; characterized in that the sheet travels in the first direction through the wrapping station and into at most the intercept position according to a second movement depending on a length of the sheet, and subsequently travels according to said first movement.

According to a preferred embodiment of the above method, said sheet forms an end portion of a continuous strip, and is detached from the strip by means of a cutting operation, which is preferably performed as the sheet and the relative strip travel according to said first movement.

Moreover, said second movement preferably involves feeding said sheet at an average speed greater than, equal to, or less than an average speed of said first movement, depending on whether the length of said sheet is greater than, equal to, or less than the spacing of the products in said second direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
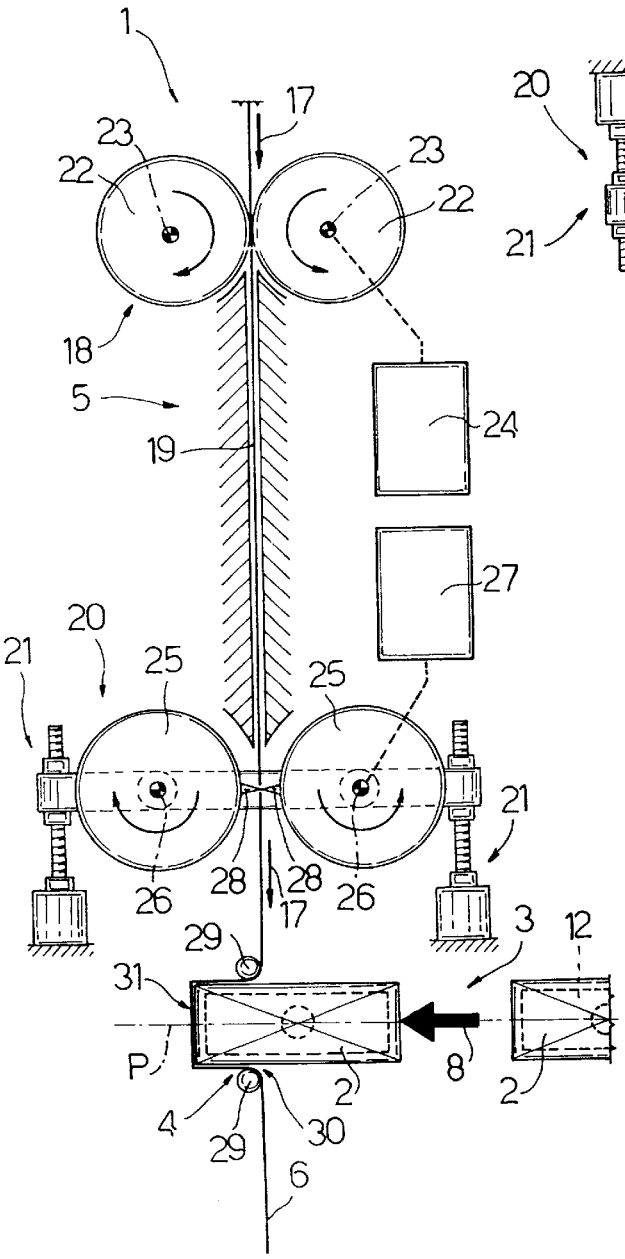
FIG. 1 shows a side view, with parts in section and parts removed for clarity, of a wrapping machine implementing the method according to the present invention.

Numeral 1 in FIG. 1 indicates a wrapping machine for wrapping products 2 comprising, in the example shown, packets or cartons of cigarettes for wrapping in sheets of overwrapping material, in particular, sheets of polypropylene.

Machine 1 comprises a conveyor 3 for feeding products 2 at constant speed along a path P and through a folding or wrapping station 4; and a unit 5 for supplying station 4 with a succession of sheets 6, each for wrapping a respective product 2.

Figure 2:
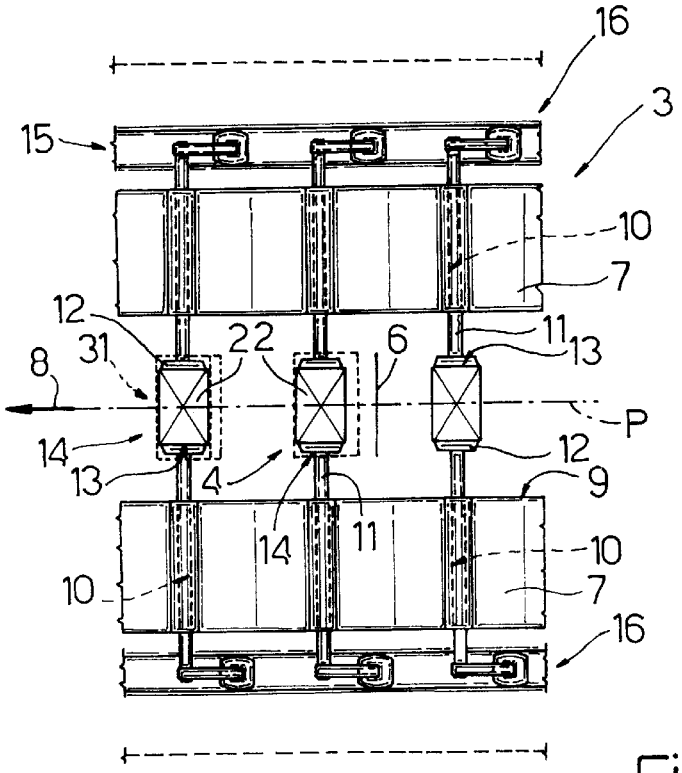
FIG. 2 shows a plan view, with parts removed for clarity, of a detail of the FIG. 1 machine.

With reference to FIG. 2, conveyor 3 comprises two parallel, coplanar conveyor belts 7, which are moved in a direction 8 by a known drive device (not shown), and define a central channel 9 parallel to direction 8.

Each belt 7 comprises a number of equally spaced through holes 10 formed in the thickness of belt 7 and perpendicular to direction 8. Each hole 10 houses in axially-sliding manner a rod 11, the free end of which, inside channel 9, is fitted with a pad 12, the transverse dimensions of which are approximately equal to but no greater than the dimensions of each of two opposite axial end surfaces 13 of product 2. Each rod 11 is coaxial with a corresponding rod 11 on the other belt 7, and both define, together with respective pads 12, a gripping device 14 of a gripping assembly 15 for retaining and feeding a product 2 along path P in direction 8.

The axial position of rods 11 and pads 12 in relation to respective belt 7 is governed by a cam actuating device 16, which forms part of assembly 15 and provides for moving pads 12 forming part of the same gripping device 14 to and from a gripping position in which pads 12 are separated by a distance approximately equal to but no greater than the length of products 2 measured perpendicularly to surfaces 13.

With reference to FIG. 1, unit 5 extends from station 4 in a direction 17 perpendicular to direction 8, and comprises an unwinding assembly 18 for feeding a strip 19 of wrapping material towards station 4 in direction 17, and a cutting device 20 located between assembly 18 and station 4, close to conveyor 3, and for cutting strip 19 into a succession of wrapping sheets 6.

The position of cutting device 20 in relation to conveyor 3 may be fixed or, as in the example shown, adjustable by means of a known adjusting device 21 for moving cutting device 20 in direction 17 and in relation to station 4.

Unwinding assembly 18 comprises a pair of rollers 22 contacting opposite surfaces of strip 19 and mounted for rotation about respective axes 23 perpendicular to the FIG. 1 plane and to directions 8 and 17; and a drive unit 24 connected mechanically to rollers 22 and for rotating rollers 22 in opposite directions at an instantaneously adjustable angular speed.

Cutting device 20 comprises a pair of rollers 25 located on either side of strip 19 and mounted for rotation about respective axes 26 parallel to axes 23; and a drive unit 27 connected mechanically to rollers 25 and for rotating rollers 25 in opposite directions at an adjustable, preferably constant angular speed. The peripheral surface of each roller 25 comprises a longitudinal blade 28, and rollers 25 are so synchronized as to bring blades 28 simultaneously into contact with, and so cut, strip 19.

At station 4, unit 5 also comprises a pair of folding rollers 29 mounted for rotation about respective axes parallel to axes 26, and located on either side of path P to define a passage 30 through which products 2 travel.

Operation of machine 1 will now be described with reference to one product 2, and as of the instant in which the leading edge of strip 19 is located at cutting device 20.

Hereinafter, the end portion of strip 19 corresponding to sheet 6 of the product 2 being considered will be referred to as "sheet 6", regardless of whether the sheet has or has not already been detached from the rest of strip 19.

As of the above instant—hereinafter referred to as the "cutting instant"—sheet 6 of the product 2 being considered is generally fed continuously by unwinding assembly 18 in direction 17, through path P and into a position tangent with rollers 29; and product 2 is fed continuously by conveyor 3 towards station 4, and, at a given instant—hereinafter referred to as the "intercept instant"—is positioned with its front surface contacting a portion of sheet 6, which, by the intercept instant, is positioned in what is referred to hereinafter as the "intercept position." Subsequently, product 2, still contacting sheet 6 and moving in direction 8, travels through passage 30 to gradually fold sheet 6 about rollers 29 and gradually form a U-shaped wrapping 31. Normally, as shown in FIG. 1, sheet 6 is detached from strip 19 during the formation of wrapping 31.

As regards performance of the above operations, it should be pointed out that product 2 is fed along path P in what, in the example shown, is a constant movement, but which in any case is such as to feed products 2 to station 4 at constant frequency. As a sheet 6 must be formed by cutting device 20 for each product 2 traveling through station 4, device 20 must be so operated that its cutting frequency equals the frequency at which products 2 are supplied to station 4.

As such, for wrappings 31 to be formed properly, which means no slippage whatsoever between sheet 6 and product 2 in the interval between the intercept and cutting instants, conveyor 3, assembly 18 and cutting device 20 must be linked by known electronic and control units (not shown) to establish a precise relationship between the movements of product 2 and sheet 6.

Figure 4:
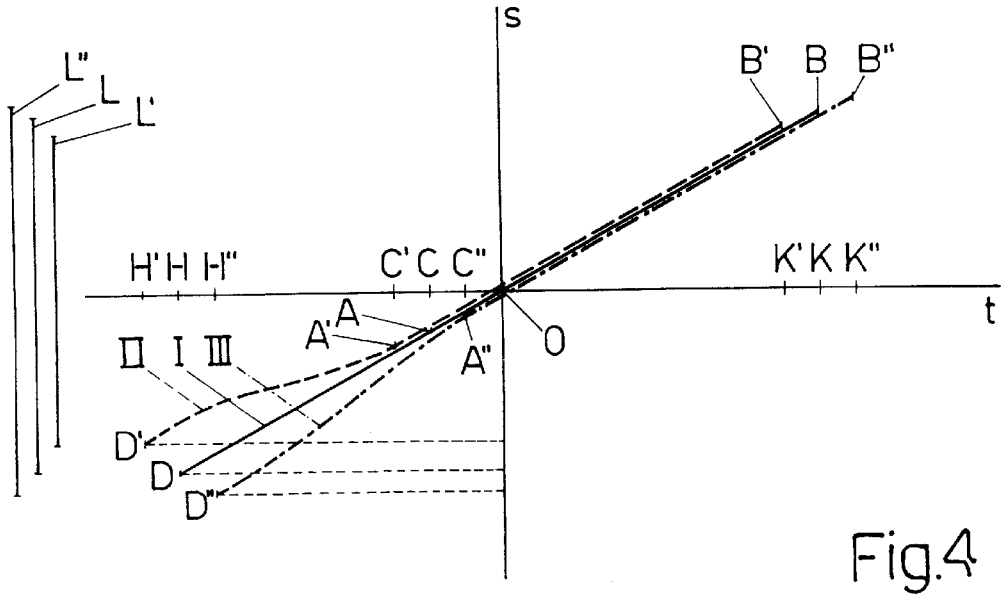
FIG. 4 shows a graph relative to operation of the FIG. 1 machine.

Such a relationship is shown by way of example in the FIG. 4 space-time graph, which relates to a machine 1 in which:

a) conveyor 3 feeds a product 2 through station 4 at each time interval HK, and imparts to product 2 a precise movement, which, in this case, involves feeding product 2 forward at constant speed;

b) drive unit 24 is so regulated as to supply sheet 6 with the same movement, i.e. at the same constant speed, as product 2 for a period CK, which falls within interval HK, and the length of which, though rightly dependent on the length of sheet 6, is in this case independent of it by being calculated according to the sheet 6 required to wrap the largest product 2 catered to by machine 1;

c) three different cases are considered: the first (curve I) relates to a product 2 of such a size as to require a sheet 6 of length L exactly equal to the spacing of products 2 along path P; the second (curve II). relates to a product 2 of such a size as to require a sheet 6 of length L' shorter than the spacing of products 2 along path P; and the third (curve III) relates to a product 2 of such a size as to require a sheet 6 of length L" greater than the spacing of products 2 along path P;

d) curves I, II and III are drawn relative to a substantially absolute reference system, the origin O of which corresponds, for all three curves, to the instant at which product 2 intercepts sheet 6.

As shown in the FIG. 4 graph, each of the three curves comprises a portion AB covered within period CK, and which corresponds to the travel of sheet 6 at constant speed constantly equal to the traveling speed of conveyor 3; and a portion DA covered at generally variable speed.

More specifically, in the case of sheet 6 of length L, portion DA is also covered at constant speed equal to the traveling speed of conveyor 3. In the case of sheet 6 of length L', portion D'A' is covered at an average speed lower than the speed of conveyor 3. In the case of sheet 6 of length L", portion D"A" is covered at an average speed higher than the speed of conveyor 3.

The different locations of cycle start and end points D and B of the three curves correspond to given variations in the timing of cutting device 20 in relation to conveyor 3; which variations are achieved either directly by acting on the angular position of rollers 25, or by moving cutting device 20 in relation to station 4 by means of adjusting device 21.

On machine 1, therefore, any slippage between sheets 6 and products 2 is prevented by so regulating the movement of sheets 6 that it is identical to the movement of respective products 2 between the intercept and cutting instants; and any change in format may be effected substantially in real time by simply varying the timing or position of cutting device 20, and by easily computerized selection of the movement of the sheets during at least part of the time interval in which sheets 6 mate with respective products 2.

The action of blades 28 is preferably, though not necessarily, perfected by so regulating drive unit 27 as to impart to blades 28, at the cutting instant, the same direction and traveling speed as strip 19.

Figure 3:
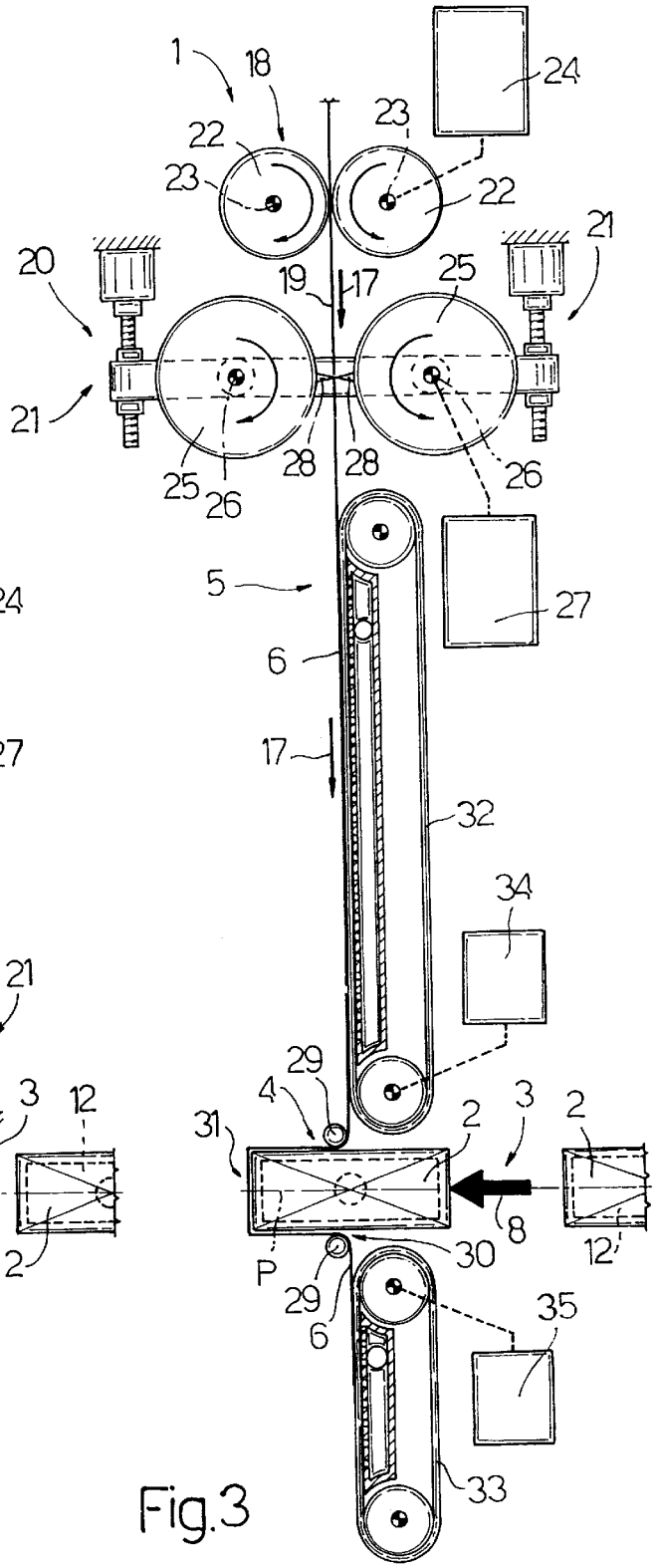
FIG. 3 shows a side view, with parts in section and parts removed for clarity, of a variation of the FIG. 1 machine.

In the FIG. 3 variation, cutting device 20 is located close to assembly 18, and unit 5 comprises two known suction belts 32 and 33, the first of which is controlled by a drive unit 34 and is interposed between device 20 and station 4, and the second of which is located downstream from station 4 and is controlled by a drive unit 35. Belt 32 successively receives sheets 6 cut by device 20 and feeds them to station 4, while belt 33 receives the portion of each sheet 6 extending beyond station 4 prior to the intercept instant.

In unit 5 according to the FIG. 3 variation, sheet 6 is detached from strip 19 before sheet 6 reaches said intercept position, as opposed to after, as in the case of unit 5 in FIG. 1. The movement imparted to belts 32 and 33 by respective drive units 34 and 35 is, however, substantially the same as that of assembly 18.

What is claimed is:

1. A method for wrapping products comprising feeding a sheet through a wrapping station in a first direction and at a first speed; feeding a product through said wrapping station in a second direction incident with said first direction and at a second speed to engage said sheet upon reaching a given intercept position, and to feed the sheet in said second direction to form a U-shaped wrapping about said product; and providing said first speed with a first value, depending on a length of the sheet, upstream from said intercept position, and with a second value equal to a value of said second speed downstream from said intercept position.

2. A method as claimed in claim 1, wherein said first speed has said first value for a period (CK) which depends on the length of the sheet.

3. A method as claimed in claim 1, wherein said first speed has said first value for a period (CK), which is a function of the length of the sheet required to wrap a product of maximum size feedable to said wrapping station.

4. A method as claimed in claim 1, wherein said sheet forms an end portion of a continuous strip, and is separated from the strip by cutting said strip.

5. A method as claimed in claim 4, wherein said cutting is performed as the sheet and strip are fed at said first value of said first speed.

6. A method as claimed in claim 4, wherein the sheet is separated from the strip after the sheet reaches said intercept position.

7. A method as claimed in claim 4, wherein the sheet is separated from the strip before the sheet reaches said intercept position.

8. A method as claimed in claim 4, wherein said cutting is performed at a constant frequency equal to a frequency at which products are fed through the wrapping station.

9. A method as claimed in claim 4, wherein said cutting is performed on said sheet at a fixed distance in relation to the wrapping station, and is timed, with respect to supply of products through the wrapping station, as a function of size of the products.

10. A method as claimed in claim 4, wherein said cutting is performed on said sheet at a distance which is variable, in relation to the wrapping station, as a function of size of the products.

11. A method as claimed in claim 4, wherein said cutting is performed by cyclic cutting means, at a cutting instant, in said first direction.

12. A method as claimed in claim 11, wherein said cutting means travels at said first speed at the cutting instant.

13. A method as claimed in claim 1, wherein an average of said first value is greater than, equal to, or less than an average of said second speed depending on whether the length of said sheet is greater than, equal to, or less than a spacing of products in said second direction.

14. A method as claimed in claim 1, wherein said second speed is constant.

15. A method as claimed in claim 1, wherein said sheet is engaged by said product at said intercept position to commence the formation of said sheet about said product, a difference between said first and second values of said first speed of said sheet upstream and downstream of said intercept position enabling said sheet to be formed about the product while the sheet travels with said product at said second speed.

* * * * *